United States Patent [19]

Keith

[11] Patent Number: 4,460,647

[45] Date of Patent: Jul. 17, 1984

[54] FIBRETS SUITABLE FOR PAPER OPACIFICATION

[75] Inventor: Charles H. Keith, Charlotte, N.C.

[73] Assignee: Celanese Corporation, New York, N.Y.

[21] Appl. No.: 417,000

[22] Filed: Sep. 13, 1982

[51] Int. Cl.[3] ..... D02G 3/00

[52] U.S. Cl. ..... 428/369; 428/372; 428/400; 428/401; 162/146; 162/157.1; 162/157.4; 162/157.5; 162/157.6

[58] Field of Search ..... 162/146, 157.1, 157.6, 162/157.5, 162, 157.4; 428/362, 369, 372, 400, 401; 264/11, 13, 14

[56] References Cited

U.S. PATENT DOCUMENTS

| | | | |
|---|---|---|---|
| 2,999,788 | 9/1961 | Morgan | 162/157.4 |
| 3,342,921 | 9/1967 | Brundige et al. | 162/157.6 |
| 3,597,312 | 8/1971 | Kohne et al. | 162/157.5 |
| 3,775,353 | 11/1973 | Kohne et al. | 162/157.5 |
| 4,040,856 | 8/1977 | Litzinger | 162/157.6 |

*Primary Examiner*—Peter Chin

*Attorney, Agent, or Firm*—Robert J. Blanke

[57] ABSTRACT

A process is disclosed for the preparation of highly pigmented fibrets, the product produced thereby and paper products containing the highly pigmented fibret. The fibret has a surface area of from 15 to 30 square meters per gram and comprises a polymeric host having an index of refraction of not more than 1.5 containing from 40 to 75 percent by weight of an inorganic light scattering pigment having an index of refraction of from 1.5 to 3.0. The fibrets are found to impart paper opacification to the same degree as wholly inorganic opacified paper products without many of the problems commonly associated with such prior art products.

6 Claims, 7 Drawing Figures

FIBRETS SUITABLE FOR PAPER OPACIFICATION

This invention relates to short fibrillar material (termed fibrets) suitable for use in paper brightening and opacification and to the resultant brightened and opacified paper products. More specifically, the invention relates to fibrets comprising an organic polymeric host material containing large amounts of an inorganic pigment or opacifying material and the addition of such fibrets to paper making stock to produce opacified paper products.

High opacity paper products are commonly prepared by the addition of white pigments such as titanium dioxide to a paper sheet material, whereby light rays striking the paper sheet are multiply refracted and reflected thereby making the paper opaque, while at the same time increasing brightness. The light rays are refracted when there is a difference in the refractive indices between air and the paper filler. A solid white material with a high index of refraction, such as titanium dioxide, can thus increase the brightness and opacity of paper when in admixture with a base of cellulose paper fibers. However, the very small particle size and granular shape of such fillers leads to a loss of these materials in the paper making process. That is to say, certain quantities of filler are not retained in the paper sheet itself but rather are passed through into the so called "white water" residue which is extracted from the aqueous slurry employed in depositing the paper pulp stock.

The use of high percentages of pigments in paper results in certain undesirable effects, chief of which are a decrease in the strength and resistance to the penetration of liquids. Ordinarily, liquid penetration is not seriously affected until 10 to 15% pigment is added, but higher percentages than this may cause considerable reduction in resistance to liquid penetration. Pigments also decrease the bulk, since the pigment is heavier than the fiber and consequently increases the weight more than the thickness of the sheet.

An undesirable effect sometimes noticed on heavily pigmented sheets is "dusting". Dusting may occur at the calenders, reels, slitters, rewinders, or at any point where the sheet is flexed. In severe cases, clouds of dust are produced. Dusting is particularly severe in groundwood sheets and papers of low moisture content. Pigments cause dusting because they weaken the structure of the sheet. Moreover, certain pigments such as titanium dioxide have a tendency to bunch or form agglomerates in paper pulp when high concentrations of titanium dioxide are employed in order to obtain maximum opacification.

Alternatively, a material of lower refractive index can provide an opacification effect by having an extensive void structure characterized by a high specific surface area. Light reflected and refracted in passing into and through the numerous voids is thoroughly scattered and imparts an opaque appearance to the material. Materials of a lower refractive index having desirable opacification effects are those cellulose ester fibrets set forth in U.S. Pat. No. 4,047,862. The fibrillar nature of the fibrets of U.S. Pat. No. 4,047,862 permits an intimate incorporation of the fibret with a base of cellulose paper fibers and a frictional or entanglement bonding therewith. The sheet strength is thus maintained at a higher level than that found for equal amounts of granular inorganic fillers. Additional processes for the preparation of cellulose ester fibrets are described in U.S. Pat. Nos. 3,342,991, 3,441,473, 2,988,469, 4,283,186 and 4,274,914. U.S. Pat. No. 4,274,914 also contemplates the presence of mineral tracers such as $TiO_2$, $BaSO_4$, and $Al_2O_3$ in the fibrets.

Other high surface area fibrillar materials obtained from wholly synthetic polymers are described in U.S. Pat. Nos. 2,988,782 and 2,999,788. U.S. Pat. No. 2,999,788 also contemplates high loadings of inert fillers such as pigments in amounts of up to 90%. These are produced by processes characterized by a rapid precipitation of a polymer in a region of high shear. While the aforementioned fibrillar materials do achieve a degree of opacification in paper products, such fibrillar materials are still unable to achieve the brightness and opacity that can be obtained with inorganic materials.

It is therefore an object of this invention to provide a paper sheet material having equal or better brightness and opacification properties than that obtained with prior art inorganic material opacified paper products without many of the problems commonly associated with prior art paper sheet material.

It is another object of this invention to provide fibret opacification materials having the ability to opacify paper products to the same degree as wholly inorganic opacified prior art paper products without many of the problems commonly associated with such prior art products.

It is still another object of this invention to provide processes for the preparation of fibret opacification materials having the opacification properties of wholly inorganic particulate material without many of the problems commonly associated with such prior art products.

In accordance with this invention, it has now been discovered that a fibrillar material having the ability to impart that degree of opacification obtained by titanium dioxide to paper products without the inherent disadvantages of inorganic opacifiers, may be obtained by incorporating in a polymeric host fibret material having an index of refraction of less than 1.5 from 40 to 80 percent by weight of an inorganic opacifier having an index of refraction of from 1.5 to 3.0, the fibret material having a surface are of from 15 to 30 square meters per gram and preferably 20 to 25 square meters per gram. Preferably, the opacifier is selected from the group consisting of titanium dioxide, calcium carbonate, silica, zinc oxide, zinc sulfide, kaolin clay and alumina, most preferably the inorganic opacifier is titanium dioxide. Preferably, the polymeric host material is a material selected from the group consisting of polymethylmethacrylate, polypropylene, polyacetyl, regenerated cellulose, cellulose acetate, cellulose butyrate, cellulose triacetate and polytetrafluro ethylene. Most preferably, the polymeric host material is cellulose acetate and the inorganic opacifier is titanium dioxide.

BRIEF DESCRIPTION OF THE DRAWINGS

A better understanding of the invention may be had from the drawings wherein:

Turning to FIG. 1, a flow sheet is set forth which is illustrative of a typical process employing paper making machinery for the preparation of the sheet like material of this invention. As can be seen from the flow sheet, a slurry of fibrets is fed from a fibret supply into a stock tank where a slurry of paper pulp is added from the pulp supply. At the mixer, the resulting fluid mass is agitated to provide uniform dispersion of solids and the amount of liquid present is adjusted. The mixer feeds the head box of the fourdrinier machine wherein the water leaf is laid down, progressing thereafter through the drier and finally to the product reel.

Prior art processes for the addition of inorganic opacifiers are generally not very complicated, such as for instance, adding opacifier dry to the paper stock and dispersing by the action of a beater. However, it is considered better practice to disperse the inorganic opacifier in water first before adding to the paper stock.

Figure 1:
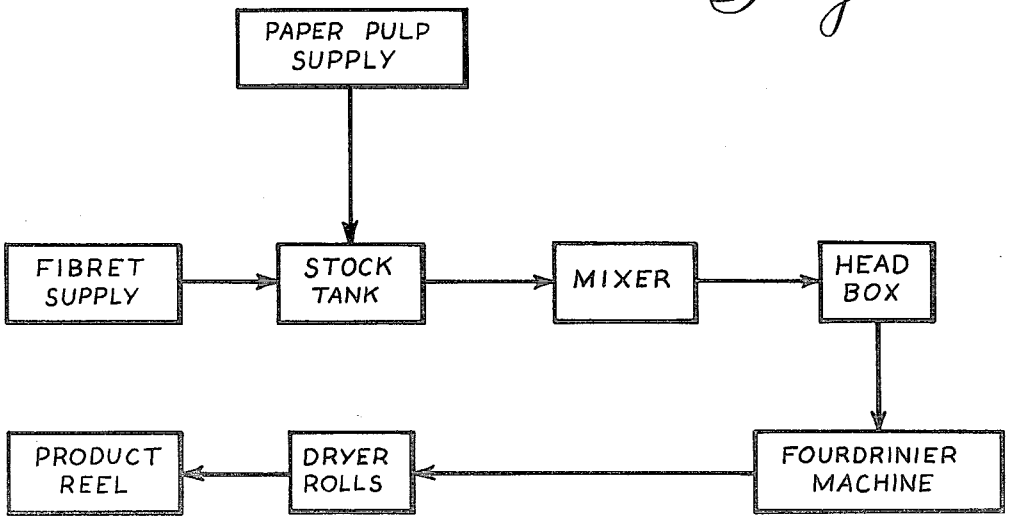
FIG. 1 is a flow sheet of a process for the preparation of the opacified paper sheets of this invention.
Figure 2:
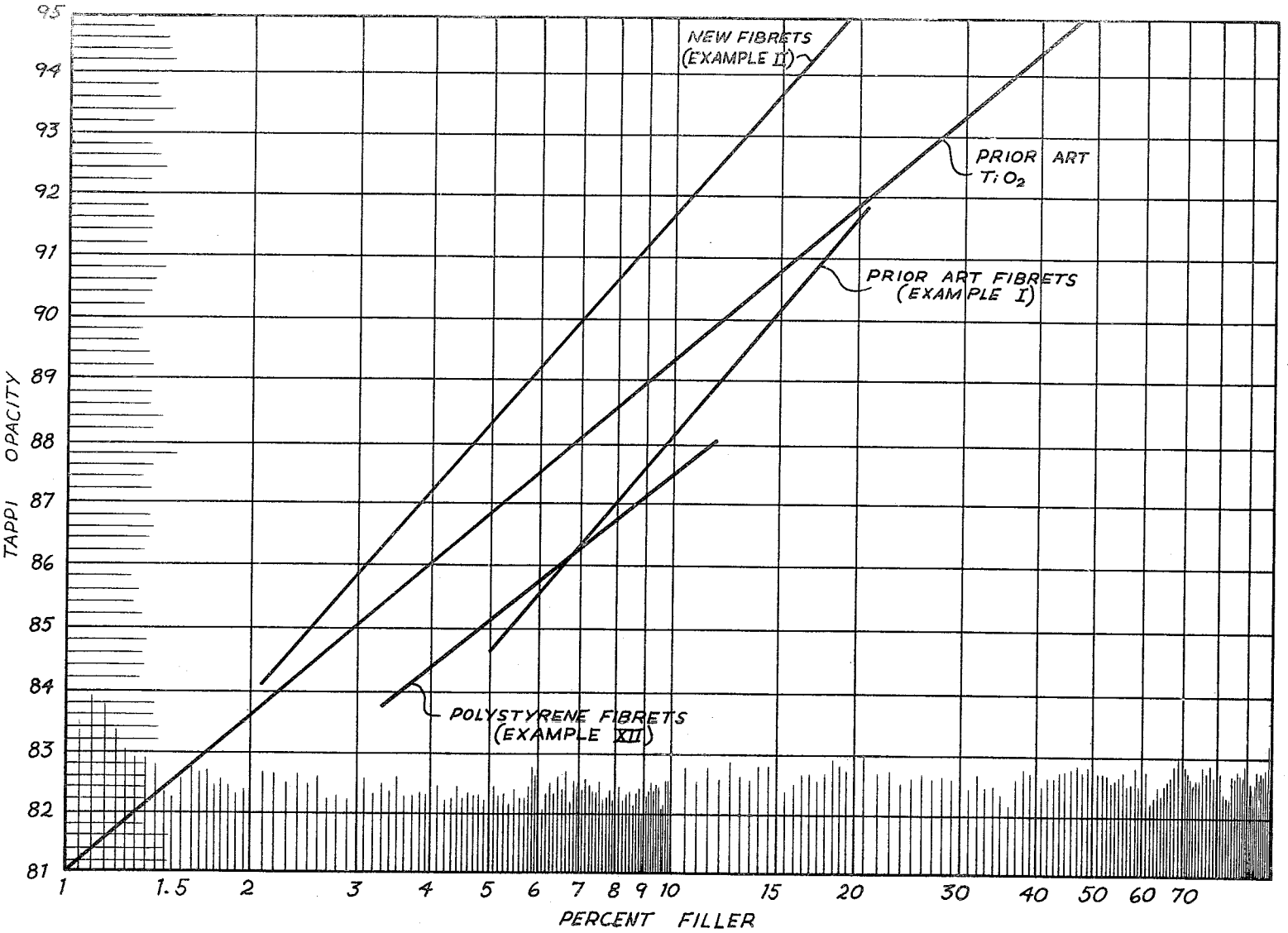
FIG. 2 is a graph plotting percent filler against opacity for paper sheets containing various prior art opacifying materials and the opacifying materials of the instant invention.
Figure 3:
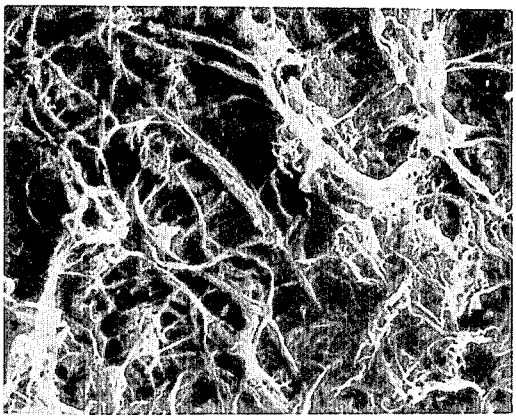
FIG. 3 is a photomicrograph magnified 1000 times of a cellulose acetate fibret devoid of inorganic opacifier material and representative of the prior art.
Figure 4:
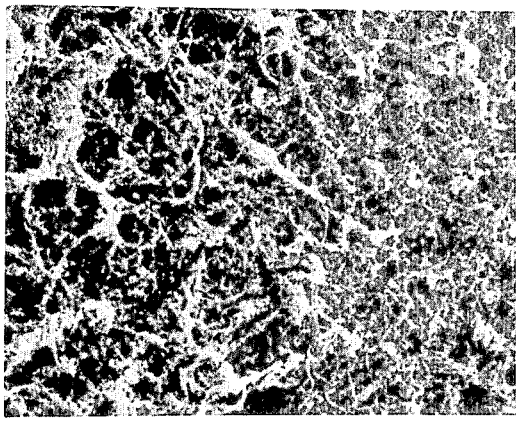
FIG. 4 is a photomicrograph magnified 1000 times of fibrets comprising cellulose acetate host fiber with a titanium dioxide opacifier, the titanium dioxide opacifier comprising 75 percent by weight and the cellulose acetate comprising 25 percent by weight of the total fibret, the fibret having been prepared from a 10 percent solids content dope.
Figure 5:
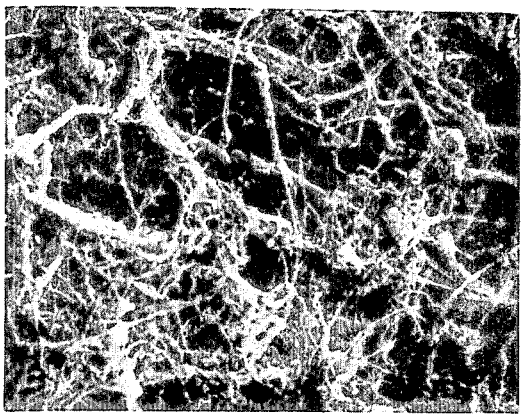
FIG. 5 is a photomicrograph magnified 1000 times of a fibret consisting of a cellulose acetate host polymer with a titanium dioxide opacifier, the titanium dioxide opacifier comprising 50 percent by weight of the fibret, the remainder being cellulose acetate, the fibret having been prepared from a 10 percent solids dope.
Figure 6:
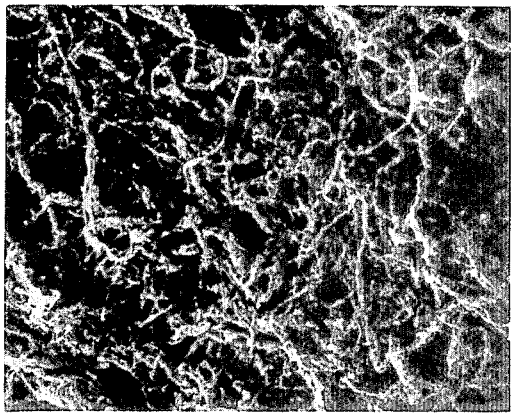
FIG. 6 is a photomicrograph mangified 1000 times of a fibret consisting of a cellulose acetate host polymer with a titanium dioxide opacifier, the titanium dioxide opacifier comprising 60 percent by weight of the fibret, the remainder being cellulose acetate, the fibret having been prepared from a 20 percent solids dope.
Figure 7:
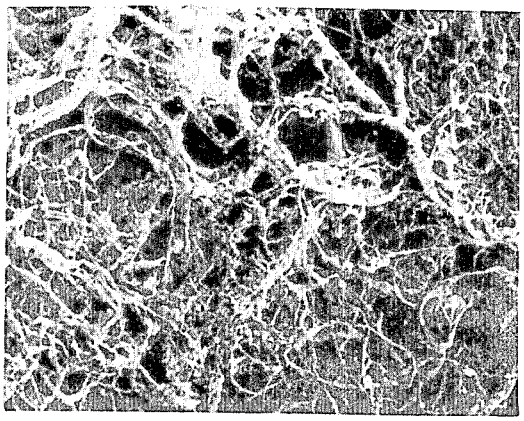
FIG. 7 is a photomicrograph magnified 1000 times of a fibret consisting of a cellulose acetate host polymer with a titanium dioxide opacifier, the titanium dioxide opacifier comprising 50 percent by weight of the fibret, the remainder being cellulose acetate, the fibret having been prepared from a 20 percent solids dope.

Various fibret containing soft wood pulp paper sheets, as prepared substantially according to the process as set forth in the description of FIG. 1 of the drawings, are measured for Tappi opacity corrected to a common sheet weight of 60 grams/square meter. Tappi opacity is then plotted against percent filler to obtain the graph as set forth in FIG. 2 of the drawings. As can be seen in FIG. 2, the control which is a paper sheet delustered with titanium dioxide alone has superior opacification properties to either prior art fibrets devoid of opacification material or fibrets comprising polystyrene host polymer containing 50% $TiO_2$ delustrant. The cellulose acetate fibret having heavy loadings of titanium dioxide delustrant however, exhibits superior opacification properties than any of the fibret products which do not meet the critical parameters of the fibrets of the instant invention or the products delustered with titanium dioxide alone.

Turning to FIGS. 3 to 7 of the drawings, it can be seen that either an increase in $TiO_2$ content or a reduction in dope solids in the process for fibret preparation will result in substantially finer fibrets. Moreover the pigmented fibrets of this invention (FIGS. 4, 5, 6 and 7) are distinctively different from nonpigmented prior art fibrets (FIG. 3), in that the pigmented fibrets of the instant invention all possess nodular portions, the nodules containing high concentrations of pigment.

The following specific examples are given for purposes of illustration and should not be considered as limiting the scope of this invention.

EXAMPLE I

Fibrets representative of prior art cellulose acetate fibrets which are free of inorganic opacifiers, were prepared from a 7.5 percent solids dope formulation containing fiber grade cellulose acetate having an acetyl value of about 55. The dope formulation consisted of 90.5 parts by weight cellulose acetate flake, 1080.0 parts by weight acetone and 120.0 parts by weight water. The acetone and water were admixed first followed by the addition of the acetate flake. The mixture was then gently tumbled until the cellulose acetate completely dissolved. Utilizing a nozzle and cap spray apparatus as prepared by Spraying Systems Company Set-Up No. 22b, 3201 Randolph Street, Bellwood, Ill. 60104, the dope was placed in a storage tank and then pumped through a centrally positioned 0.40 inch extrusion nozzle at a rate of 420 grams per minute. Precipitating and attenuating water at 60° to 65° C. was pumped through the three orifices surrounding the extrusion nozzle at a rate of 9 to 10 liters per minute at a pressure of 180 lbs. per square inch. The dope water mixture exits through a 0.110 inch orifice located 0.14 inch away from the dope nozzle into a tub filled with water where the fibrets are precipitated. The fibrets were then collected and purified and were found to have a surface area of 24.6 square meter per gram.

EXAMPLE II

A slurry is prepared from 300 grams of titanium dioxide, 50 grams of cellulose acetate and 617.5 grams of acetone and 32.5 grams of water. This mixture is dissolved and milled in a ball mill for thirty minutes to achieve a dispersion. The titanium dioxide employed was "UNITANE" 0310 (fiber grade anatase titanium dioxide manufactured by American Cyanamid Company). 66.5 grams of cellulose acetate, 593 grams of acetone, 75.35 grams of water are then added to 266.5 grams of the previously prepared titanium dioxide dispersion and tumbled until dissolved. The resultant 16% dope formulation containing 50% solids weight titanium dioxide is pumped at a rate of 604 grams per minute through a Zenith pump into a nozzle and cap spray apparatus Set-Up No. 22b, as prepared by Spray Systems Company, 3201 Randolph Street, Bellwood, Ill. 60104. The dope was found to have a viscosity of 464 centipoises and is pumped through a centrally positioned 0.40 inch extrusion nozzle. Precipitating and attenuating water at a temperature of 85° to 90° C. is pumped through the three orifices surrounding the extrusion nozzle at a rate of 9 to 10 liters per minute at a pressure of 200 lbs. per square inch. The dope water mixture exits through a 0.110 inch orifice located 0.14 inch away from the dope nozzle into a tube filled with water where the fibrets are precipitated. The fibrets are then collected and pressure cooked at 15 lbs. per square inch at a temperature of 120° C. for two hours. The fibrets are then passed through a Gaullin homogenizer at a pressure of 3000 psi and suction filtered to form a wet cake containing about 17% solids. The fibrets were found to have a surface area of 23.4 square meters per gram. The fibrets are then formulated into paper sheets by the process as set forth in Example A.

EXAMPLE III

The process of Example II is repeated except that the addition of cellulose acetate dope solids to the titanium dioxide dispersion is adjusted such that a 10% dope formulation containing 50% solids weight titanium dioxide is obtained. The formulation is found to have a viscosity of 48 centipoises and is pumped by means of a Zenith pump into the nozzle and cap spray apparatus employed in Example II employing identical sebsequent processing conditions. The resultant fibrets were found to have a surface area of 23.4 square meters per gram.

EXAMPLE IV

The process of Example II is repeated except that the addition of cellulose acetate dope to the titanium dioxide dispersion is adjusted such that a 20% dope solids formulation containing 50% solids weight titanium dioxide having a viscosity of 1620 centipoises is obtained. The formulation is pumped by means of a Zenith pump into the cap and spray apparatus of Example II employing thereafter the same processing conditions as set forth in Example II. The resultant fibrets were found to have a surface area of 22.9 square meters per gram.

EXAMPLE V

The process of Example II is repeated except that the ratio of the blending of the titanium dioxide dispersion and the cellulose acetate dope is adjusted such that a 10% dope solids formulation is obtained containing 60% solids weight of titanium dioxide. The resultant dope formulation is found to have a viscosity of 43 centipoises and is pumped by means of a Zenith pump into the nozzle and cap spray apparatus of Example II. Subsequent processing conditions are identical with those employed in Example II. The resultant fibrets are found to have a surface area of 18.6 square meters per gram.

EXAMPLE VI

The process of Example II is repeated except that the blending of the titanium dioxide dispersion and the cellulose acetate dope is adjusted such that a 20% dope solids formulation is obtained containing 60% solids weight titanium dioxide having a viscosity of 443 centipoises. The dope formulation is pumped by means of a Zenith pump into the nozzle and cap spray apparatus of Example II. Subsequent processing conditions are employed which are identical to those set forth in Example II. The resultant fibrets were found to have a surface area of 21.0 square meters per gram.

EXAMPLE VII

The process of Example II is repeated except that the blending of the titanium dioxide dispersion with the cellulose acetate dope is adjusted such that a 23% dope solids formulation is obtained containing 60% solids weight of titanium dioxide, the dope formulation having a viscosity of 1100 centipoises. The dope formulation is pumped by means of a Zenith pump into the nozzle and cap spray apparatus of Example II. Subsequent processing conditions are identical with those set forth in Example II. The resultant fibrets were found to have a surface area of 21.6 square meters per gram.

EXAMPLE VIII

The process of Example II is repeated except that the blending of the titanium dioxide dispersion and the cellulose acetate dope are adjusted such that a 10% dope solids formulation is obtained containing 75% solids weight of titanium dioxide. The dope formulation is found to have a viscosity of 19 centipoises and is pumped by means of a Zenith pump into the nozzle and cap spray apparatus of Example II. Subsequent processing conditions are identical to those set forth in Example II. The resultant fibrets were found to have a surface area of 20.3 square meters per gram.

EXAMPLE IX

The process of Example II is repeated except that the blending of the titanium dioxide dispersion and the cellulose acetate dope are adjusted such that a 26% dope solids formulation is obtained containing 75% solids weight titanium dioxide. The resultant dope formulation is found to have viscosity of 450 centipoises and is pumped by means of a Zenith pump into the nozzle and cap spray apparatus of Example II. Subsequent processing conditions identical to those set forth in Example II are employed. The resultant fibrets were found to have a surface area of 20.6 square meters per gram.

EXAMPLE X

The process of Example II is repeated except that the blending of the titanium dioxide dispersion and the cellulose acetate dope are adjusted such that a 29.5% dope solids formulation is obtained containing 75% solids weight titanium dioxide. The resultant dope formulation is found to have a viscosity of 1050 centipoises and is pumped by means of a Zenith pump into the nozzle and cap spray apparatus of Example II. Subsequent processing conditions identical to those set forth in Example II are employed. The resultant fibrets were found to have a surface area of 20.2 squre meters per gram.

EXAMPLE XI

A 15% solids dope formulation containing styrene dissolved in a 50/50 blend of methylethyl ketone and acetone is prepared. The formulation is pumped by means of a Zenith pump into the nozzle and cap spray apparatus as set forth in Example II employing precipitating and attenuating water at 20° C. The fibrets are washed three times with water at 20° C. and vacum dried at 35° C. and finally redispersed in cold water and passed through a Gaullin homogenizer. The fibrets are then vacum filtered to form a wet cake containing 14% solids.

EXAMPLE XII

The process of Example XI is repeated except that sufficient titanium dioxide was milled into the 15% solids styrene dope to produce a dope formulation containing 50% solids weight titanium dioxide. The resultant fibrets were found to have a surface area of 15.9 square meters per gram.

EXAMPLE XIII

The process of Example II was repeated except that the titanium dioxide delustrant was placed with "UNITANE" 0450 (fiber grade rutile titanium dioxide marketed by American Cyanamid Company).

EXAMPLE XIV

The process of Example II was repeated except that the titanium dioxide was replaced with "UNITANE" 0110 (paper grade anatase titanium dioxide marketed by American Cyanamide Company).

EXAMPLE XV

The process of Example II was repeated except that the titanium dioxide pigment was replaced with zinc oxide.

EXAMPLE XVI

The process of Example II was repeated except that the titanium dioxide pigment was replaced with calcium carbonate.

EXAMPLE XVII

The process of Example II was repeated except that the titanium dioxide pigment was replaced with kaolin clay.

EXAMPLE XVIII

The process of Example II was repeated except that the titanium dioxide pigment was replaced with "SILANOX" (fumed silica marketed by Cabot Corporation of Boston Mass.).

EXAMPLE XIX

The process of Example II is repeated except that the titanium dioxide delustrant is replaced with zinc sulfide.

EXAMPLE XX

The process of Example II is repeated except that the titanium dioxide delustrant is replaced with perlite.

EXAMPLE XXI

The process of Example II is repeated except that the titanium dioxide delustrant is replaced with a 50/50 blend of zinc oxide/titanium dioxide.

EXAMPLE XXII

The process of Example II is repeated except that the titanium dioxide is replaced with a 50/50 blend of calcium carbonate/titanium dioxide.

EXAMPLE XXIII

A 50% aqueous solution of "Hostalux" EBX-A (optical brightener marketed by American Hoechst Corporation) is prepared. 42.5 grams of the aqueous mixture is then added to 250 grams of the fibrets of Example II and cooked with stirring at 80° C. for 15 minutes. The mixture is then filtered under vacuum, washed three times in cold water, and again vacuum filtered to produce a solid cake.

EXAMPLE A

Paper hand sheets are prepared from a 200 milliliter pulp suspension comprising 2.40 grams of unbeaten soft wood pulp. The pulp suspension is then dispersed in 8½ liters of water and allowed to drain through an 8×8 screen of 80 mesh wire. The sheet thus formed is then placed between two pieces of blotting paper which are then placed between two pieces of felt and then run into a set of couch rolls at a pressure of 50 lbs. per linear inch. The sheet is then removed and placed with the felt or upper side down against a smooth metal ferrotype plate. Two sheets of blotting paper are superimposed followed by another metal plate. A six metal plate sandwich is produced. The metal sandwich is then pressed for five minutes at 4000 lbs. (50 lbs. per square inch on the sheet). The six metal plate sandwich is then disassembled and the paper hand sheets reversed so as to press the wire side of the sheet. After the final pressing, the paper sheet is then run through a print dryer operated at 80° to 90° C. The reflectance value of the sheets are then measured as is sheet weight. The reflectance values are used to calculate TAPPI opacities by the Kubelka-Munk relationships. The TAPPI opacities are then plotted against percent filler on a logarithmic scale and TAPPI opacities at 5, 10 and 15% filler reported in Table 1.

EXAMPLE B

Paper hand sheets are prepared from a 200 milliliter pulp suspension comprising 2.28, 2.16 and 2.04 grams of unbeaten soft wood pulp and 0.12, 0.24 and 0.36 grams of "Unitane" 0-110 (anatase $Tio_2$ marketed by American Cyanamid Company) so as to produce hand sheets containing 5%, 10% and 15% filler respectively. The pulp suspension is then dispersed in 8½ liters of water and processed to finished paper sheets according to the process set forth in Example A. The reflectance value of the sheets are then measured as is sheet weight and the percent filler in the sheets. The reflectance values are used to calculate TAPPI opacities by the Kubelka-Munk relationships. The TAPPI opacities are then plotted against percent filler on a logarithmic scale and TAPPI opacities at 5, 10 and 15% filler reported in Table I.

EXAMPLE C

The process of Example B is repeated except that "Unitane" 0–310 (anatase $TiO_2$ marketed by American Cyanamid Company) is employed in place of the "Unitane" 0–110.

EXAMPLE D

The process of Example B is repeated except that "Unitane" 0–450 (rutile $TiO_2$ marketed by American Cyanamid Company) is employed in place of the "Unitane" 0–110.

EXAMPLE E

Paper hand sheets are prepared from 200 milliliters pulp suspensions comprising 2.28, 2.16 and 2.04 grams of unbeaten soft wood pulp and 0.12, 0.24 and 0.36 grams of the fibret fillers of Examples I to XXIII so as to produce hand sheets containing 5%, 10% and 15% filler respectively. The pulp suspensions are then dispersed in 8½ liters of water and processed to finished paper sheets according to the process set forth in Example A. The reflectance value of the sheets are then measured as is sheet weight and the percent filler in the sheets. These are then used to calculate opacities at 5, 10 and 15% filler which are reported in Table 1.

TABLE I

| EXAMPLE | DESCRIPTION | BRIGHTNESS RANGE % | TAPPI OPACITY, 60 g/m² SHEETS AT 5% Filler | 10% Filler | 15% Filler | REPLACEMENT RATIO (LB. $TiO_2$ FIBRETS AT EQ. OPAC.) 5% Filler | 10% Filler | 15% Filler | PIGMENT SCATTERING COEF. (MC2/g) | PERCENT RETENTION |
|---|---|---|---|---|---|---|---|---|---|---|
| A | NO FILLER | 92.0–94.3 | — | 82.2 | — | — | — | — | — | — |
| B | "UNITANE" 0-110-(ANATASE $TiO_2$) | 93.4–95.4 | 86.8 | 89.6 | 91.2 | 1.0 | 1.0 | 1.0 | 3580 | 27 |
| C | "UNITANE" 0-310-(ANATASE $TiO_2$) | 93.0–94.6 | 88.9 | 90.5 | 91.4 | 1.7 | 1.3 | 1.0 | 5620 | 8 |
| D | "UNITANE" 0-450 (RUTILE $TiO_2$) | 93.7–94.5 | 88.1 | 90.9 | 92.5 | 1.4 | 1.4 | 1.4 | 4710 | 11 |
| I & E | UNPIGMENTED FIBRETS | 92.6–93.7 | 85.6 | 87.8 | 89.1 | 0.75 | 0.64 | 0.59 | 2460 | 86 |
| II & E | PIGMENTED-50% 0-310 16% Solids | 93.0–94.8 | 88.0 | 91.4 | 93.3 | 1.4 | 1.6 | 1.7 | 4630 | 83 |
| III & E | PIGMENTED-50% 0-310 10% Solids | 93.1–94.4 | 87.9 | 91.3 | 93.3 | 1.3 | 1.5 | 1.7 | 4700 | 81 |
| IV & E | PIGMENTED-50% 0-310 20% Solids | 94.0–94.7 | 87.9 | 91.0 | 92.9 | 1.3 | 1.4 | 1.5 | 4450 | 81 |
| V & E | PIGMENTED-60% 0-310 10% Solids | 92.3–92.7 | 87.4 | 90.8 | 92.9 | 1.2 | 1.4 | 1.5 | 4220 | 84 |
| VI & E | PIGMENTED-60% 0-310 20% Solids | 93.6–94.6 | 87.7 | 91.3 | 93.4 | 1.3 | 1.5 | 1.7 | 4480 | 83 |
| VII & E | PIGMENTED-60% 0-310 23% Solids | 94.1–94.7 | 88.0 | 91.6 | 93.7 | 1.4 | 1.7 | 1.9 | 4750 | 80 |
| VIII & E | PIGMENTED-75% 0-310 10% Solids | 93.8–94.7 | 88.7 | 91.8 | 93.6 | 1.6 | 1.7 | 1.8 | 5200 | 61 |
| IX & E | PIGMENTED-75% 0-310 26% Solids | 93.9–94.3 | 88.6 | 92.0 | 93.9 | 1.6 | 1.8 | 1.9 | 5210 | 67 |
| X & E | PIGMENTED-75% 0-310 29.5% Solids | 94.0–94.4 | 87.9 | 91.5 | 93.6 | 1.3 | 1.6 | 1.8 | 4670 | 74 |
| XI & E | POLYSTYRENE | 9.38–94.4 | 82.3 | 85.7 | 87.7 | 0.34 | 0.39 | 0.42 | 1600 | 100 |
| XII & E | POLYSTYRENE PIGMENTED 50% - 0-310 | 94.0–94.5 | 84.6 | 88.0 | 90.0 | 0.59 | 0.68 | 0.75 | 2500 | 100 |
| XIII | PIGMENTED-50% 0-450 | 93.9–94.9 | 88.2 | 91.9 | 94.1 | 1.4 | 1.8 | 2.0 | 5020 | 80 |
| XIV | PIGMENTED-50% 0-110 | 93.7–94.3 | 87.5 | 90.6 | 92.4 | 1.2 | 1.3 | 1.3 | 4690 | 73 |
| XV & E | PIGMENTED-50% ZnO | 92.9–94.3 | 85.7 | 87.7 | 88.8 | 0.78 | 0.63 | 0.55 | 2570 | 75 |
| XVI & E | PIGMENTED-50% $CaIO_3$ | 93.1–93.3 | 85.1 | 87.2 | 88.3 | 0.67 | 0.56 | 0.49 | 2170 | 79 |
| XVII & E | PIGMENTED-50% Kaolin | 92.4–93.1 | 85.1 | 87.1 | 88.2 | 0.67 | 0.55 | 0.48 | 2000 | 62 |
| XVIII & E | PIGMENTED-50% Silanox | 92.0–92.2 | 82.1 | 83.4 | 84.1 | 0.32 | 0.22 | 0.17 | 770 | 51 |
| XIX & E | PIGMENTED-50% ZnS | 92.9–93.7 | 86.6 | 90.2 | 92.3 | 0.97 | 1.2 | 1.3 | 3460 | 75 |
| XX & E | PIGMENTED-50% Perlite | 88.7–91.6 | 84.6 | 87.5 | 89.1 | 0.59 | 0.60 | 0.60 | 1660 | 74 |
| XXI & E | PIGMENTED-25% ZnO, 25% $TiO_2$ | 93.8–94.2 | 86.3 | 89.2 | 90.9 | 0.90 | 0.92 | 0.93 | 3120 | 79 |
| XXII & E | PIGMENTED-25% $CaCO_3$, 25% $TiO_2$ | 92.7–93.2 | 85.5 | 89.2 | 91.3 | 0.74 | 0.92 | 1.0 | 2700 | 78 |
| XXIII & E | PIGMENTED-50% $TiO_2$ + optical brightener | 93.6–93.9 | 88.0 | 91.7 | 93.8 | 1.4 | 1.7 | 1.9 | 4760 | 85 |

In order to evaluate the strength of paper sheets containing the fibrets of the instant invention, the fibrets of Example II were added to a pulp (246 Canadian—standard freeness, 50/50 hardwood, softwood) in quantities sufficient to produce proper sheets having opacity levels of 84, 86, 88, 90 and 92, the sheets being prepared according to the description of FIG. 1 of the drawings. The fibret containing paper sheets were evaluated against sheets having anatase $TiO_2$ substituted for the fibrets in quantities sufficient to achieve opacity levels of 84, 86, 88, 90 and 92. The samples were measured for internal bond, and corresponding % retention of initial strength and Mullen burst strength and corresponding % retention of initial strength, all of the values being reported in Table II.

As can be seen in reviewing Table 1 of the drawings, fibrets whether pigmented or unpigmented have a vastly higher percent retention than $TiO_2$ alone. With regard to the pigment employed in the fibret, $TiO_2$ exhibited superior opacity because of the maximized differential between the index of refraction of the cellulose ester host polymer and $TiO_2$ pigment. Correspondingly, polystyrene even though pigmented with $TiO_2$ did not exhibit superior opacity because the polystyrene host polymer reduced the differential between the index of refraction of the pigment and the host polymer. It should also be noted that the presence of an optical brightener increases opacity or can be seen from a comparison of the data of Example II and XXIII.

TABLE II

STRENGTH DATA
(PULP 246 Canadian standard freeness, 50/50 HARDWOOD, SOFTWOOD)

| EXAMPLE | OPACITY LEVEL | MATERIAL | INTERNAL BOND (.001 ft. lb.) | % RETENTION OF INITIAL STRENGTH | MULLEN BURST STRENGTH* (psi) | % RETENTION OF INITIAL STRENGTH |
|---|---|---|---|---|---|---|
| | 84 | $Tio_2$ | 101 | 74 | 20.3 | 83 |
| | 84 | Fibrets | 107 | 79 | 21.1 | 87 |
| | 86 | $Tio_2$ | 91 | 67 | 19.1 | 78 |
| | 86 | Fibrets | 100 | 74 | 20.2 | 83 |
| | 88 | $Tio_2$ | 80 | 59 | 17.8 | 72 |
| | 88 | Fibrets | 93 | 68 | 19.2 | 79 |
| | 90 | $Tio_2$ | 70 | 51 | 16.5 | 67 |
| | 90 | Fibrets | 86 | 63 | 18.3 | 75 |
| | 92 | $Tio_2$ | 60 | 44 | 15.3 | 62 |
| | 92 | Fibrets | 79 | 58 | 17.3 | 71 |

*An instrumental method which measures the ability of a sheet to resist rupture by pressure exerted by an inflated diaphragm. A detailed description of the method appears in Paper Board Packaging, Volume No. 64 No. 6, paper 83, 84, 88, 90 and 92, June 1979.

The improvement in strength as a result of the use of the fibrets of this invention rather than prior art $TiO_2$ for papers of equal opacity levels is readily apparent.

Having thus disclosed the invention, what is claimed is:

1. A fibret suitable as an additive for paper opacification, said fibret having a surface area of from 15 to 30 square meters per gram and comprising a polymeric host having an index of refraction of not more than 1.5 and being selected from the group consisting of polymethylmethacrylate, polypropylene, polyethylene, polyacetyl, regenerated cellulose, cellulose acetate, cellulose butyrate, cellulose triacetate and polytetrafluro ethylene and from 40 to 75% by weight of titanium dioxide light scattering pigment.

2. The product of claim 1 wherein said polymeric host material is cellulose acetate.

3. The product of claim 1 containing an optical brightener.

4. A shaped opacified paper structure containing at least some fibrets having a surface area of from 15 to 30 square meters per gram and comprising a polymeric host selected from the group consisting of polymethylmechacrylate, polypropylene, polyethylene, polyacetyl, regenerated cellulose, cellulose acetate, cellulose butyrate, cellulose triacetate and polytetraflueo ethylene and from 40 to 75% by weight of titanium dioxide light scattering pigment.

5. A product of claim 4 wherein said polymeric host material is cellulose acetate.

6. The product of claim 4 wherein said fibrets contain an optical brightener.

* * * * *